United States Patent [19]

Sadler

[11] 4,441,859

[45] Apr. 10, 1984

[54] ROTOR BLADE FOR A GAS TURBINE ENGINE

[75] Inventor: John H. R. Sadler, Derby, England

[73] Assignee: Rolls-Royce Limited, London, England

[21] Appl. No.: 341,189

[22] Filed: Jan. 20, 1982

[30] Foreign Application Priority Data

Feb. 12, 1981 [GB] United Kingdom ..... 8104334

[51] Int. Cl.[3] ..... F01D 5/10; F01D 5/18

[52] U.S. Cl. ..... 416/96 A; 416/145; 416/500

[58] Field of Search ..... 416/96 A, 145, 500; 415/119

[56] References Cited

U.S. PATENT DOCUMENTS

| | | | |
|---|---|---|---|
| 1,833,754 | 11/1931 | Paget | 416/500 X |
| 2,310,412 | 2/1943 | Flanders | 416/500 X |
| 2,349,187 | 5/1944 | Meyer | 416/500 X |
| 2,844,303 | 7/1958 | Kristiansen | 416/145 |
| 2,862,686 | 12/1958 | Bartlett | 416/500 X |
| 2,999,668 | 9/1961 | Howald et al. | 416/500 X |
| 3,680,977 | 8/1972 | Rabouyt et al. | 415/172 A |
| 3,754,838 | 8/1973 | Fu et al. | 416/500 X |
| 3,986,792 | 10/1976 | Warner | 416/500 |
| 4,171,184 | 10/1979 | Lings et al. | 416/96 A X |
| 4,182,598 | 1/1980 | Nelson | 416/500 X |
| 4,355,957 | 10/1982 | Sifford et al. | 416/145 |

FOREIGN PATENT DOCUMENTS

| | | | |
|---|---|---|---|
| 949459 | 8/1949 | France | 416/90 |
| 981599 | 5/1951 | France | 416/500 |
| 2067675 | 7/1981 | United Kingdom | 416/500 |

*Primary Examiner*—Philip R. Coe
*Assistant Examiner*—Frankie L. Stinson
*Attorney, Agent, or Firm*—Cushman, Darby & Cushman

[57] ABSTRACT

A rotor blade for a gas turbine engine is provided with an internal tip damper comprising a damper weight which rotates under centrifugal load to cam itself into engagement between two components of the aerofoil, in particular the interior surface of the hollow aerofoil and the tip of a cooling air entry tube. By altering the degree of offset between the center of gravity of the weight and its support the frictional engagement may be varied.

10 Claims, 5 Drawing Figures

ROTOR BLADE FOR A GAS TURBINE ENGINE

This invention relates to a rotor blade for a gas turbine engine.

One problem which has troubled such blades has been that of excessive vibration. In the case of shrouded blades which are interconnected at the tips of their aerofoils this vibration has been relatively easily dealt with but in the case of unshrouded blades the problem is much more difficult. Various types of dampers have been proposed for reducing the vibration of blades. Generally these fall into two classes of dampers, one class comprising features external of the aerofoil and the other comprising features internal of the aerofoil.

The present invention relates to the latter class. Various proposals have been made for these types of dampers, and in particular it has been proposed that a weight of ceramic or other material should be arranged to move with the cooling air entry tube which is often a feature of the blades in question and to rub against this internal surface by centrifugal force. The problem with this arrangement lies in the difficulty of arranging that the centrifugal load on the damper weight gives the desired degree of frictional engagement.

In the present invention a blade is provided with a damper which enables the force causing frictional engagement to be preset within a relatively wide range.

According to the present invention a rotor blade for a gas turbine engine comprises two components having different vibrational characteristics, facing surfaces of the components defining a gap between the components, and a damper weight located in the gap and supported eccentrically so that under centrifugal force the weight is caused to rotate and to engage frictionally with the facing surfaces.

Preferably the two components comprise the hollow aerofoil and an internal air entry tube. The facing surfaces may then comprise the tip of the air entry tube and the internal face of the tip of the aerofoil, or alternatively may comprise surfaces of projections.

The damper is preferably supported by its engagement with the inner surface of the tip of the aerofoil.

The invention will now be particularly described merely by way of example with reference to the accompanying drawings in which.

Figure 1:
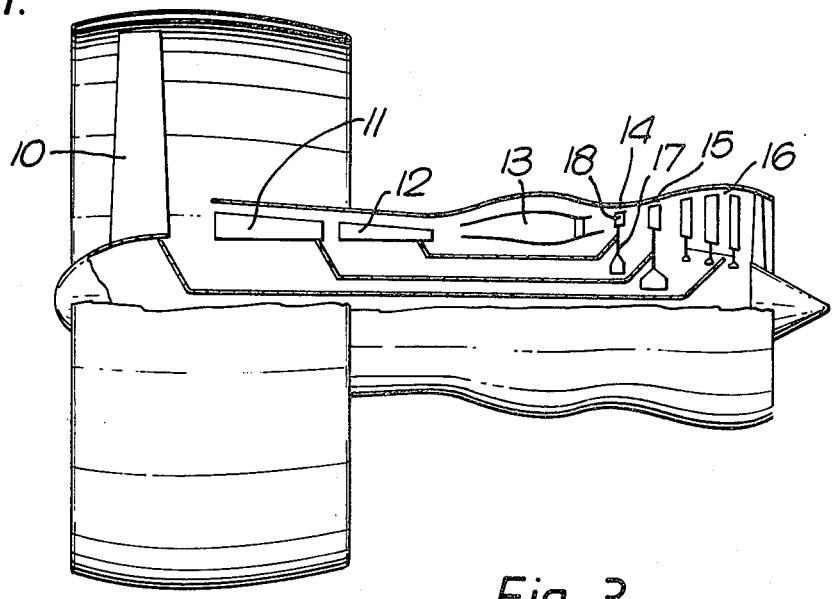
FIG. 1 shows a gas turbine engine having rotor blades in accordance with the invention.

In FIG. 1 there is shown a gas turbine engine which in the present instance comprises a fan engine. The engine has a fan 10, intermediate pressure and high pressure compressors 11 and 12, a combustion chamber 13 and high pressure, intermediate pressure, and low pressure turbines 14, 15 and 16. As is normal practice the fan 10 and low pressure turbine 16 are interconnected as are the intermediate pressure compressor 11 and turbine 15 and the high pressure compressor 12 and turbine 14. Operation of the engine overall is conventional and is not elaborated upon in this specification.

The high pressure turbine 14 comprises a turbine disc 17, from which are supported a row of turbine blades 18. One of the blades 18 is shown in enlarged radial cross section in FIG. 2.

Figure 2:
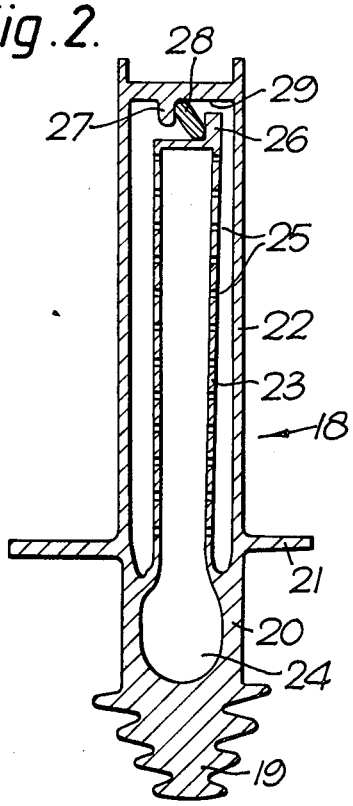
FIG. 2 is an enlarged radial section through a blade of the engine of FIG. 1.

As can be seen in FIG. 2 the blade 18 consists of a root section 19, which is formed to engage with a correspondingly shaped slot in the rim of the disc 17 to support the blade. A shank 20 extends from the root 19 and supports a platform member 21 and a hollow aerofoil 22. Because the blade operates in a very high temperature environment it is necessary to provide cooling for the aerofoil and this is carried out in the present instance by the provision of a cooling air entry tube 23. The hollow interior of the tube 23 is provided with cooling air which flows from a cavity 24 in the shank 20 and which in turn is fed from an external source (not shown). Cooling air which flows into the tube 23 passes through small holes 25 in the tube and impinges upon the interior surface of the hollow aerofoil of 22 and thus cools it. The spent cooling air is then allowed to flow through apertures (not shown) in aerofoil 22 to rejoin the main gas flow of the engine.

Because of the different dimensions of the aerofoil 22 and the cooling air entry tube 23 they have different vibrational characteristics. It is therefore generally true that if the aerofoil 22 makes considerable absolute vibrational movement it will perform an even greater movement with respect to the tube 23. If it can be arranged that these two components are in frictional engagement either directly or through the effect of an intermediate piece then frictional losses will provide effective damping of the aerofoil vibration. In the present instance such an engagement is provided by the provision of an upstanding projection 26 on the tube 23 and an inwardly extending projection 27 from the tip of the hollow aerofoil 22. Between the facing surfaces of these two projections a ceramic damper weight 28 is located. The weight 28 is asymmetrically shaped and is supported against centrifugal loads by its engagement with the inner surface 29 of the tip of the aerofoil. The dimensions and shape of the weight 28 are such that its centre of gravity is out of radial alignment with its point of contact with the surface 29. Under centrifugal load the weight 28 will therefore rotate anti-clockwise as shown in the drawing. Because of its asymmetric shape this rotation will cause a side-ways load on the projections 26 and 27. As the aerofoil 22 vibrates with reference to the tube 23 movement will be caused between the weight 28 and the projection 26 and this will lead to frictional losses which will damp the vibration.

Figure 3:
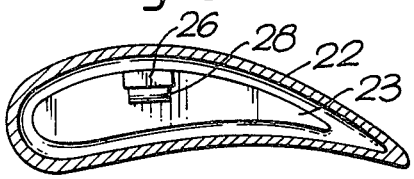
FIG. 3 is a section on the line 3—3 on FIG. 2.

FIG. 3 shows that the damper 28 need not extend the full length of the tube 23 and both it and the projections 26 and 27 are in fact of a length which is only a fraction of the chord of the aerofoil 22.

Clearly the side-load exerted by weight 28 on the projection 26 will depend on the mass of weight and on the degree of offset between its centre of gravity and its point of contact with the surface 29. It is therefore possible to adjust the configuration of the weight to produce a desired side load from the projection 26. Should it be found that the correct degree of load on the projection 26 to provide the necessary damping is such that undue stresses are produced in the tube 23 it would of course be possible to arrange a further weight similar to 28 which will engage with the opposite face of the projection 26 and will therefore provide a balance load on the tube 23. It should also be noted that the projections 26 and 27 effectively retain the weight 28 so that it cannot fall out of its desired position.

Figure 4:
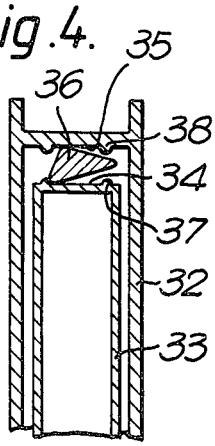
FIG. 4 is a view similar to FIG. 2 but of a further embodiment.

FIG. 4 shows a further embodiment. In this case the blade is generally similar to the blade 18 and has a hollow aerofoil 32 and cooling air in the tube 33. In this case, however, there is no projection corresponding to 26, instead the tube 33 has a radially outwardly extending tip surface 34 which faces the radially inwardly facing surface 35 of the interior of the aerofoil 32 between these faces a damper weight 36 is located. Once again the damper weight 36 which may be of ceramic or a similar material, is asymmetrical in section and is formed so that its centre of gravity is not radially aligned with its point of contact with the surface 35. Once again under the influence of centrifugal loads the weight 36 will tend to rotate counter-clockwise and its left-hand extremity will engage with the surface 34 to provide the necessary frictional engagement between the components 32 and 33. Damping is effected in a similar fashion to the previous embodiment.

Once again the load applied by the weight 36 to the surface 34 will depend upon the weight of the damper and the degree of offset between the centre of gravity and the point of contact with the surface 35. These dimensions are easily predetermined to give a desired load.

The surfaces 34 and 35 do not provide positive location of the weight 36 and therefore these surfaces are provided with raised portions 37 and 38 which may take the form of circular ridges. The clearance between the ridges 37 and 38 is arranged to be insufficient for the weight 36 to escape.

Figure 5:
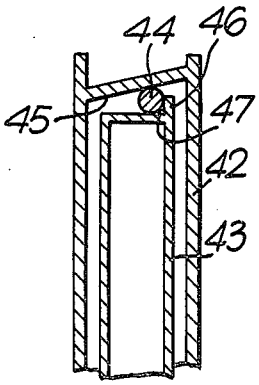
FIG. 5 is a view similar to FIG. 4 but of another embodiment.

FIG. 5 shows a further modification. Once again the aerofoil 42 and internal air guide tube 43 provide the two components of the blade, and a cylindrical ceramic roller 44 provides the damping weight. In this case, however, the weight 44 is retained against centrifugal loads by its engagement with the internal surface 45 of the tip of the aerofoil. The surface 45 is canted with respect to the direction of the centrifugal load on the roller and therefore the roller tends to run up the surface to engage with the projection 46 from the tube 43, whose surface 47 provides the other of the two damping surfaces.

Although it is not immediately apparent, the operation of this embodiment relies on the same principle as the preceding embodiments but here the offset of centre of gravity and support is provided by the angle of the surface 45 rather than the eccentricity of the damper weight.

It will be seen that by using the principle of an eccentrically mounted damper to provide the necessary frictional load on the facing surfaces of the two components of the blade it is possible to provide a load which may be adjusted within a relatively wide range and thus may be arranged to provide optimal damping of a blade at the best position for internal damping.

I claim:

1. A rotor blade for a gas turbine engine comprising:

a hollow aerofoil having a predetermined vibrational characteristic;

a component mounted internally of said hollow aerofil and having a vibrational characteristic different from said vibrational characteristic of said hollow aerofoil;

said hollow aerofoil and said component having facing surfaces defining a gap therebetween; and a damper weight having a center of gravity and positioned internally of said aerofoil in said gap betwen said facing surfaces of said hollow aerofoil and said component, said damper weight being eccentrically mounted within said gap with a first point of contact with a one of said facing surfaces on said hollow aerofoil and a second point of contact with another of said surfaces which is on said component, said first point of contact being out of radial alignment with said center of gravity of said damper weight to cause said damper weight, when under centrifugal force, to rotate about said first point of contact and to apply a sideways load to both said hollow aerofoil and said component and to further frictionally engage with both of said facing surfaces.

2. A rotor blade as claimed in claim 1, and in which said damper weight comprises an asymmetrical section and is supported against centrifugal force by its engagement with a surface which is not parallel with the direction of the force.

3. A rotor blade as claimed in claim 1 and in which said damper weight comprises a symmetrical section and is supported against centrifugal force by its engagement with a surface canted with respect to a direction of said centrifugal force.

4. A rotor blade as claimed in any one of claims 2 or claim 3 and in which said hollow aerofoil has a tip with an internal surface and in which said damper weight is supported against centrifugal force by its engagement with the internal surface of the tip of the hollow aerofoil.

5. A rotor blade as claimed in claim 3 and in which said hollow aerofoil has a tip which defines said canted interior surface and in which said damper weight comprises a roller engaging between the canted internal surface of the tip of the aerofoil of the blade and a projection from the tip of an internally mounted air entry tube.

6. A rotor blade as claimed in claim 1 in which said component comprises an internally mounted air entry tube.

7. A rotor blade as claimed in claim 6 and in which said facing surfaces comprise a surface of a projection from said hollow aerofoil and a surface of a projection from said air entry tube and arranged to retain said damper weight in position.

8. A rotor blade as claimed in claim 6 and in which said hollow aerofoil and said air entry tube each having a tip and in which said facing surfaces comprise a radially facing internal surface of the tip of the hollow aerofoil and a radially facing surface of the tip of the air entry tube.

9. A rotor blade as claimed in claim 8 and in which said facing surfaces comprise projections arranged to retain said damper weight in position.

10. A rotor blade as claimed in claim 1 and in which said damper weight comprises a ceramic material.

* * * * *